United States Patent [19]

Eitzinger

[11] Patent Number: 4,509,646

[45] Date of Patent: Apr. 9, 1985

[54] INSPECTION, REJECTION AND SORTING MACHINE

[75] Inventor: Robert Eitzinger, Deerfield, Ill.

[73] Assignee: Mid-West Automation Inc., Wheeling, Ill.

[21] Appl. No.: 424,110

[22] Filed: Sep. 27, 1982

[51] Int. Cl.[3] ..... B07C 5/344

[52] U.S. Cl. ..... 209/573; 209/698; 209/916; 209/600; 198/395; 198/398

[58] Field of Search ..... 209/571, 573, 574, 698, 209/644, 916, 539, 552, 555, 556, 600, 657, 509, 918, 655; 53/500; 198/395, 398

[56] References Cited

U.S. PATENT DOCUMENTS

| | | | |
|---|---|---|---|
| 2,208,202 | 7/1940 | Stanton et al. | 209/698 X |
| 2,357,783 | 9/1944 | Snelling | 209/916 X |
| 2,781,126 | 2/1957 | Wood | 209/600 |
| 2,794,535 | 6/1957 | Hauschild et al. | 209/571 |
| 3,260,363 | 7/1966 | Vukosic | 198/398 |
| 4,155,455 | 5/1979 | Spierer et al. | 209/570 X |
| 4,410,227 | 10/1983 | Prunella et al. | 209/573 X |

*Primary Examiner*—Robert B. Reeves
*Assistant Examiner*—Glenn B. Foster

[57] ABSTRACT

A machine adapted to receive in a continuous order the finished manufactured parts for inspection as to completeness and operativeness, for rejection of part failures, and sorting by proper orientation the accepted, tested, finished work pieces.

8 Claims, 6 Drawing Figures

INSPECTION, REJECTION AND SORTING MACHINE

SUMMARY OF THE INVENTION

A machine which includes a feed track over which finished manufactured parts consisting of electrical terminals are fed into a position where each part can be electrically tested for operativeness and either accepted or rejected. As each finished part has a proper forward edge it is necessary to determine, for the purpose of loading the parts into an acceptance storage tube, whether or not the part has proceeded through the inspection and rejection stations with that edge leading. After the proper determination of the position of the part in the track the part will pass into a switch area where the part will be fed over one storage track, or, in the alternative, if the part is disoriented through 180°, it will be fed by the switch track into a different storage tube.

The device includes a set of upper and lower probes with each set of probes being cam controlled so as to move into operative contact with the electrical conductors on both top and bottom of the part and electrically tested.

The machine provides a pair of horizontally slidable gates functioning as a part of a pair of electrically operated solenoids for the rejection of parts failing to meet the electrical inspection.

BRIEF DESCRIPTION OF THE DRAWINGS

The invention will be best understood by reference to the accompanying drawings which illustrate the preferred embodiment of the apparatus by which the stated objects of the invention are achieved, and in which.

GENERAL DESCRIPTION

The apparatus of this invention consists of a continuous track through which work pieces are caused to be moved so as to pass through an inspection station, a rejection station, an orientation station, and a sorting station. The apparatus may be operated in conjunction with other machinery which fabricates the electrical terminal parts which constitute the work piece and all that is required is that the feed track be made available to receive the same either from a reservoir of finished work pieces or directly from the last manufacturing stage.

Figure 1:
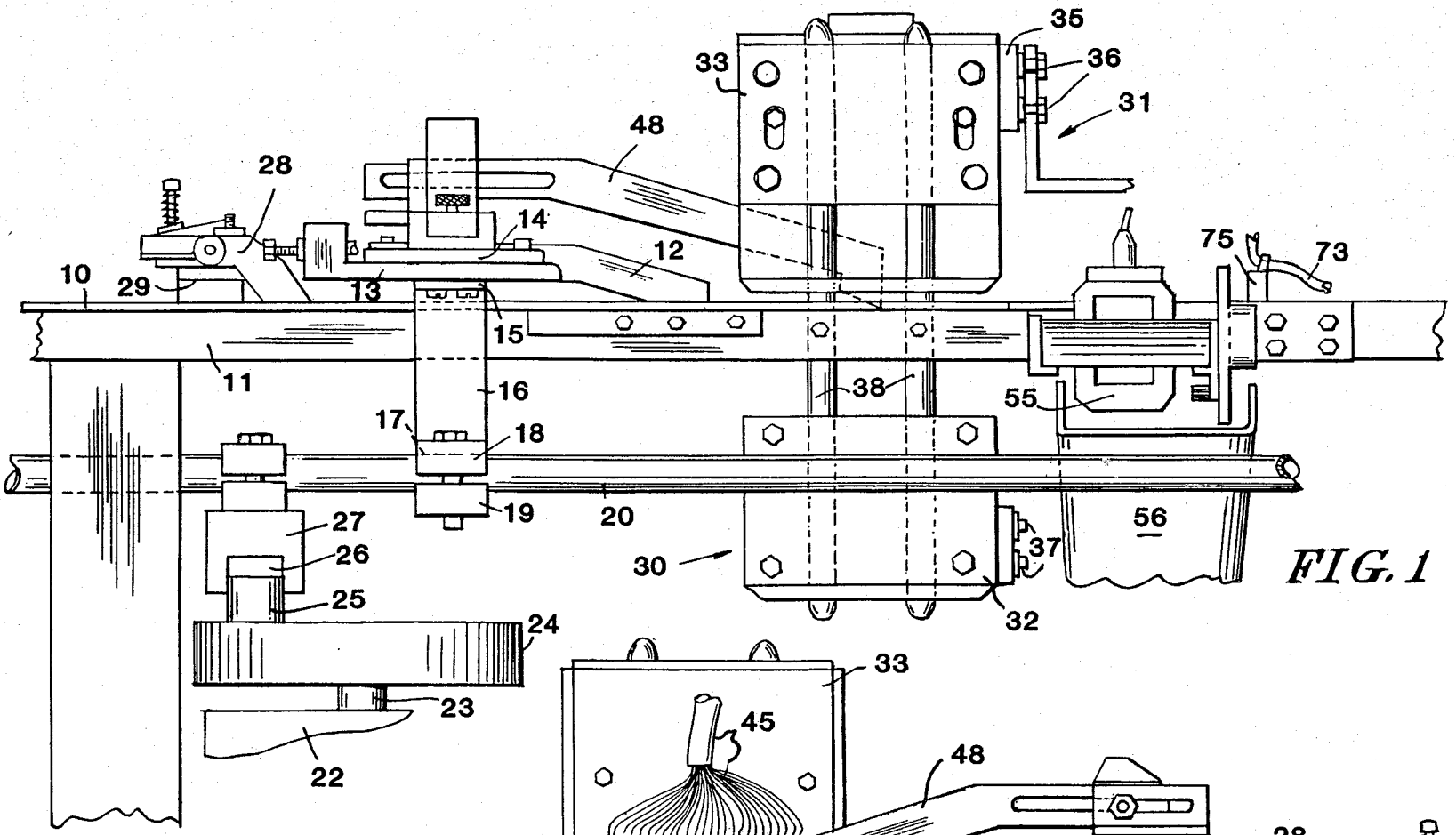
FIG. 1 is a fragmentary side elevational view of the feed and inspection section of the apparatus.

As illustrated in FIG. 1, there is shown a feed mechanism for the apparatus. A track 10 is supported by suitable panels 11 with the track 10 extending longitudinally through the different stations of the apparatus.

A feed pawl 12 is mounted on a carrier plate 13 which, in turn, is connected to a horizontally extending support 14. The free end of the support 14 has connected thereto an adjustment plate 15. Depending from the under side of the adjustment plate 15 is an L-shaped arm 16, the base leg 17 of which is connected to a top clamp bar 18. The clamp bar 18 cooperates with a lower clamp bar 19 to form a fixed connection onto a pair of horizontally extending drive rods 20 and 21.

Figure 2:
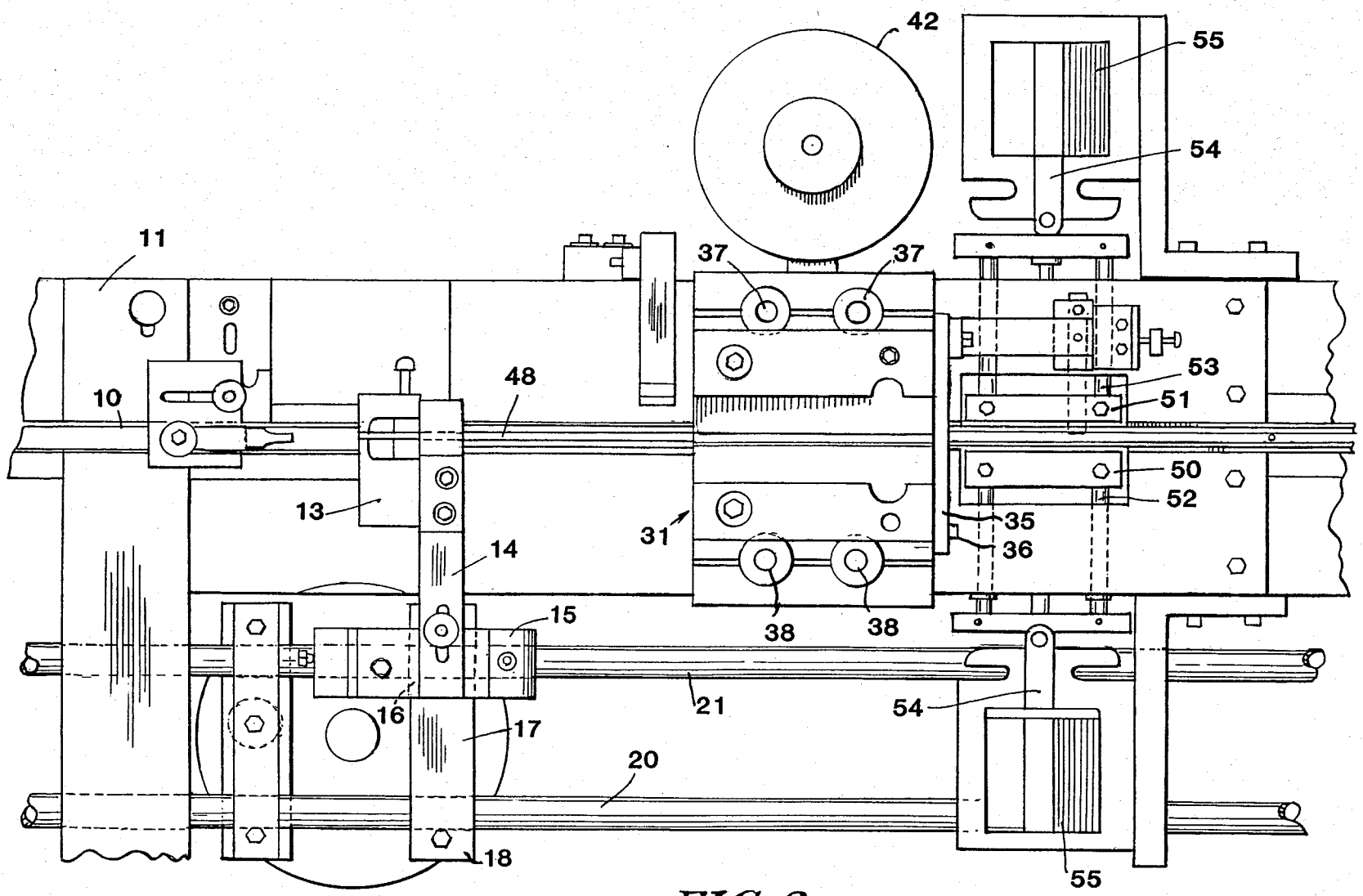
FIG. 2 is a top plan view of the apparatus illustrated in FIG. 1.

Positioned beneath the track 10 is an electric motor 22 having a driven shaft 23 that rotates a drive plate 24. The drive plate 24 is provided with an upstanding drive pin 25 which has its free end projected into a slot 26 formed in a push bar 27. As shown in FIGS. 1 and 2, the push bar 27 is fixed onto the rods 20 and 21, and thus when the drive plate 24 is caused to rotate by the motor 22, the cooperating action between the drive pin 25 and the push bar 27 will cause the rods to move reciprocally back and forth through a horizontal plane.

As the feed pawl 12 is directly connected to the rods 20 and 21, it too will move in a reciprocal manner relative to the track 10. By this arrangement, on each forward stroke of the feed pawl 12 an electrical work piece will be fed over the track 10 and into the area constituting the inspection station.

To assist the feed pawl 12 in its operation of moving the work pieces in one direction over the track 10 there is provided a fixed antibackup pawl 28. This pawl is mounted upon a base 29 carried by one of the panels 11 to one side of the track 10, as seen in FIG. 2. It is the function of this antibackup pawl 28 to prevent retracting movement of the work pieces in the track during the movement of the feed pawl 12 in one direction, such as from right to left, as viewed in FIG. 1.

Figure 3:
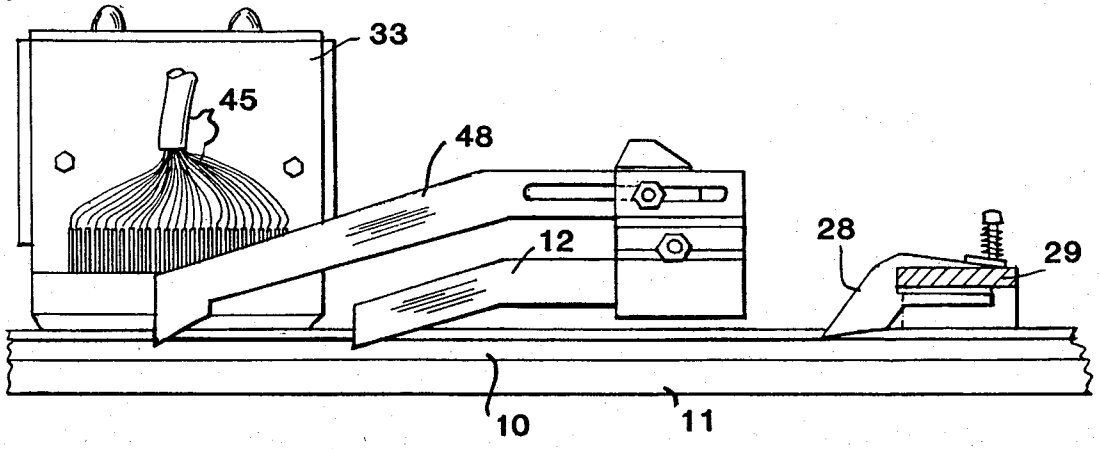
FIG. 3 is a fragmentary side elevational view of the inspection station of the apparatus.
Figure 4:
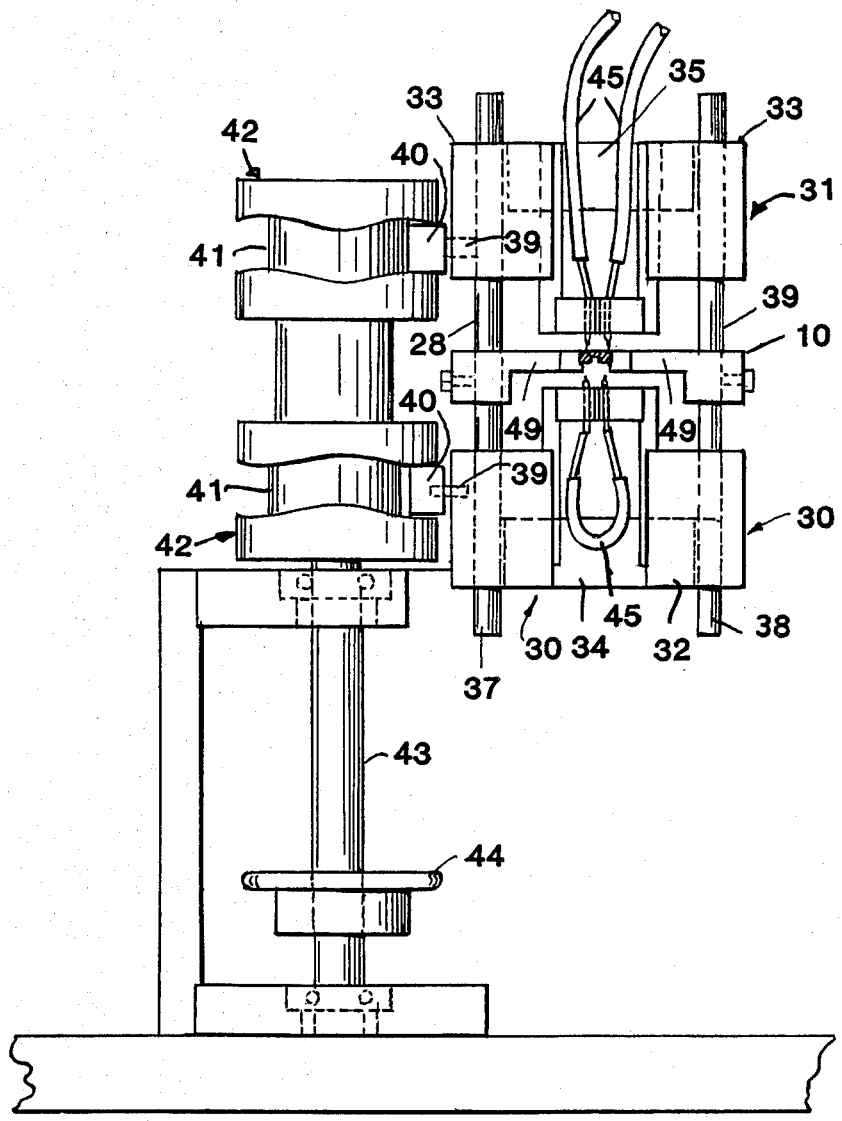
FIG. 4 is a fragmentary front elevational view of the inspection station of the apparatus.

The inspection area, as illustrated in FIGS. 1, 2, and 3, includes a double set of inspection probes 30 and 31. Each set of inspection probes 30 and 31 consists of a pair of mounting blocks 32 and 33. Each pair of mounting blocks 32 and 33 in each set of inspection probes 30 and 31 are connected together by a transversely extending connecting plate 34 and 35 which, by means of bolts 36, are connected to the respective pair of blocks 32 and 33. Each pair of blocks 32 and 33 are slidably mounted on pairs of vertically extending guide rods 37 and 38. Each block 32 has extending from one side thereof a shaft 39 on which is rotatably mounted a cam roller 40. As shown in FIG. 4, these cam rollers 40 ride in a cam track 41 formed in cam drums 42. The cam drums 42 are rotatably mounted on a shaft 43 which has connected thereto a drive pulley 44. This drive pulley 44 by a suitable drive belt, not shown, is connected to a drive shaft of the electric motor 22.

By this arrangement, when the shaft 43 is caused to rotate, it, in turn, will rotate the cam drums 42, and as the cam rollers 40 follow in the cam track 41, the inspection probes 30 and 31 will be caused to move in opposite reciprocal movements on the rods 37 and 38.

Figure 5:
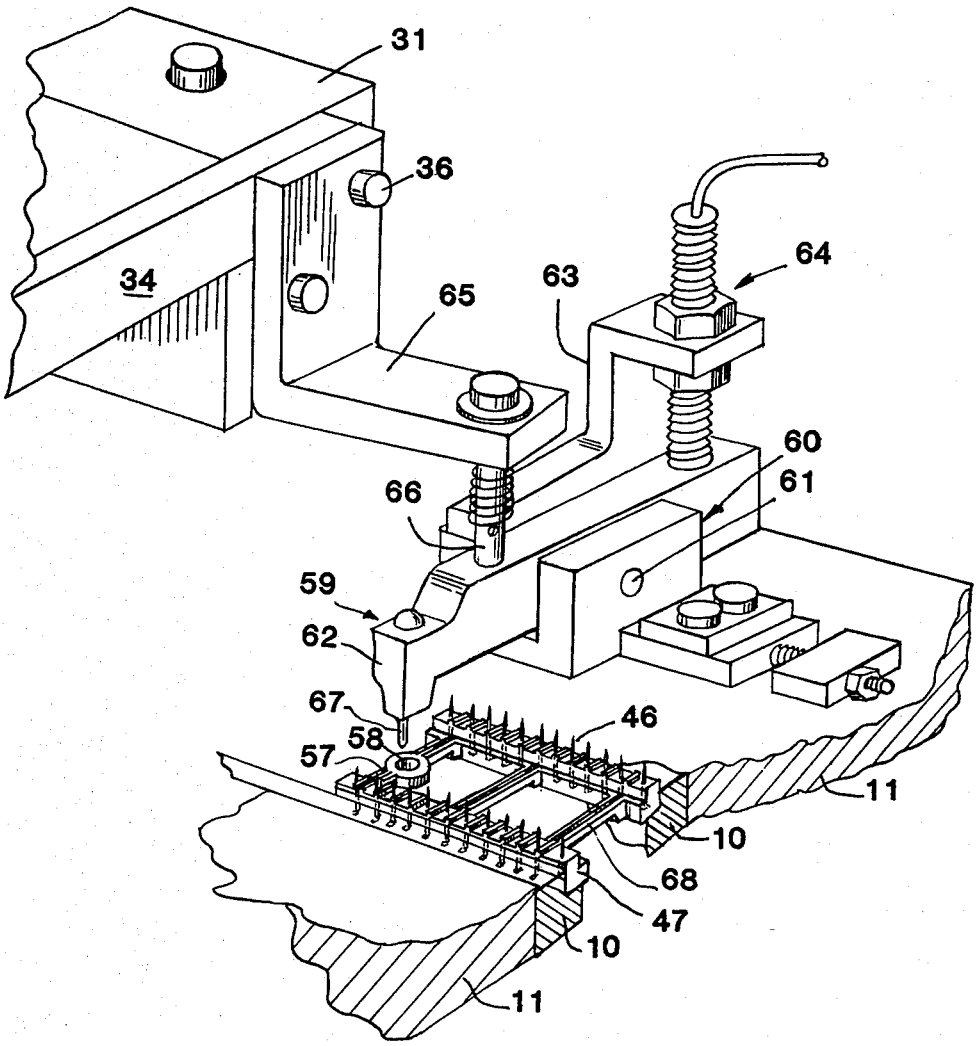
FIG. 5 is an enlarged fragmentary perspective view of the orientation station of the apparatus.

Each confronting face of the blocks 32 and 33 are provided with a plurality of electrical finger probes 45 which will engage corresponding electrical terminals 46 carried by the electrical work piece 47 (see FIG. 5). By a suitable electrical circuitry these finger probes 45 will determine whether or not the terminals 46 of the work piece 47 are present and in proper relation to each other.

Also mounted on the carrier plate 13 is a second feed pawl 48. As this feed pawl 48 moves in conjunction with the feed pawl 12 it will engage a work piece that has been inspected and move the same over the track 10 into the rejection station of the apparatus.

Referring to FIG. 4, it is noted that within the inspection station the track for the finished work piece 47 comprises two spaced apart rails 49 which are fixedly supported on the rods 37 and 38. The inner confronting end of the rails 49 are notched so as to provide supporting shoulders which will receive and support opposite longitudinal edge portions of the finished work piece 47. This bottomless track section permits the inspection probes 30 and 31 to engage the top and bottom of the work piece simultaneously in the manner hereinbefore described.

The pawl 48 functions to move the inspected work piece out of the inspection station and into the rejection gates.

As shown in FIG. 2, the rejection gates consist of a pair of elongated bars 50 and 51. These bars are carried by extension rods 52 and 53 that project from the movable armatures 54 of a pair of electrical solenoids 55. The confronting edges of the bars 50 and 51 are likewise formed to provide shoulders which will receive and support the opposite longitudinal edges of the finished work piece. In the event that the work piece has satisfactorily been inspected, the bars 50 and 51 will remain in alignment with the rails 49 and the work piece will be passed thereover.

In the event that the work piece is found defective during its inspection by the probes 30 and 31, the feed pawl 48 will move the defective piece out of the inspection station, and, in so doing, will push whatever accepted piece that is positioned on the bars 50 and 51 longitudinally out of the rejection station. As the feed pawl 48 finishes its stroke and has deposited the defective work piece on the bars 50 and 51 the solenoids 55 through a suitable circuit, not shown, will be momentarily energized so as to retract their respective armatures 54 causing the bars 50 and 51 to separate permitting the defective part to fall into a rejection shoot 56 positioned beneath the bars 50 and 51 as shown in FIG. 1.

By reference to FIG. 5 there is illustrated in perspective a type of finished work piece 47 that is inspected and sorted for storing by the present apparatus. As such, the work piece 47 provides a trailing edge 57 which is provided with a circular bearing 58 as well as the upstanding electrical contacts or terminals 46. It is this circular bearing 58 that is utilized in determining the proper orientation of the work piece 47 as it passes through the apparatus and into the sorting and storing stations.

To determine the proper orientation of the work piece 47 there is provided an orientation probe 59.

As shown in FIG. 5, this orientation probe is mounted to one side of the track 10 immediately adjacent to the rejection gates. The orientation probe 59 includes a mounting bracket 60 consisting of a U-shaped body which has pivotally supported between the arms thereof on a pivot pin 61 a finger probe 62. By a second bracket 63 there is mounted in spaced relation to one end of the finger probe 62 a proximity switch 64.

Mounted on one side of the inspection probes block 33 is an L-shaped mounting arm 65 which supports a spring urged plunger 66. As the plunger 66 is attached to the inspection probe block 33 it will move reciprocally through a vertical plane as the probes are moved in a manner hereinbefore described.

When the finished work piece 47 has been passed through the rejection station of the apparatus the orientation probe 59 will function as follows. As the inspection probe block 33 moves through its prescribed vertical path to test a subsequent work piece, it will cause the plunger 66 to engage the top edge of the probe finger 62. This will cause the probe finger 62 to pivot on the pivot pin 61 relative to the mounting bracket 60. If the probe feeler 67 enters into the circular bearing 58, the tail portion of the probe finger 62 will be brought in close proximity to the proximity switch 64 and cause the same to be actuated.

In the event that the work piece 47, as shown in FIG. 5, was oriented through 180° about a vertical axis the probe feeler 67 would engage a solid cross bar 68 and this would prevent pivoting of the probe finger 62 to such a degree that the tail portion thereof would not approach the proximity switch 64 and would not cause the same to be actuated.

Figure 6:
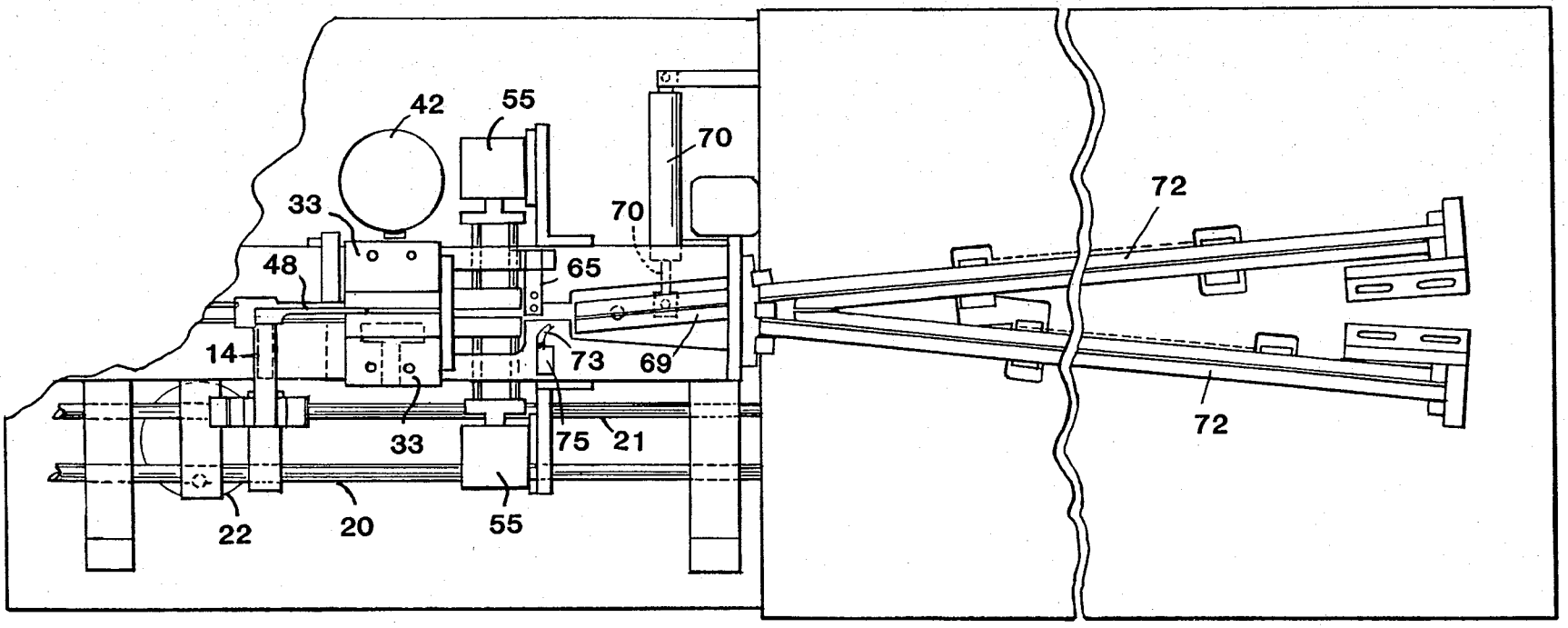
FIG. 6 is a top plan view of the inspection and storage station of the apparatus.

As shown in FIG. 6, there is a pivotal track section 69 which is connected to the free end of a piston 70 of an air cylinder 71. The operation of the air cylinder 71 is in response to the switching condition of the proximity switch 64. If the orientation probe permits the energization of the proximity switch 64, the switch track will be switched in one direction. If, however, on the next succeeding operation of the apparatus the proximity switch 64 is not closed the air cylinder will function through its piston 70 to switch the track 69 into its second position. In each of the track positions it will be aligned with an elongated storage tube track 72 that will receive the correctly oriented work pieces as they are passed out of the apparatus. It may be desired that each work piece that is passed beyond the orientation probe be counted, and this can be done through either an electrical switching contact or other suitable means so that after a given number of parts are passed into their respective storage tubes the storage tube can be replaced.

To aid in the movement of the work pieces 47 through the switch track 69 and into the storage tube track 72, there may be provided a pneumatic air nozzle 73 which is shown in FIGS. 1 and 6. This nozzle 73 is mounted on a block 75 to one side of the track and will emit a sufficient blast of air onto the work piece to slide it thereover into its proper storage tube.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described the invention, what I claim as new and desire to protect by Letters Patent is:

1. An apparatus for inspecting, orienting, and sorting finished work pieces possessing exposed electrical terminals having a designated leading edge, comprising:

(a) an elongated track extending horizontally through the apparatus, (b) a feed means for moving randomly oriented work pieces into an inspection station of the apparatus, (c) means for reciprocally moving said feed means relative to said track for feeding finished work pieces into the inspection station of the apparatus, (d) sets of electrical probes positioned above and below said track and adapted to be moved through a vertical plane into electrical contact with each work piece fed therebetween by said feed means, (e) means for reciprocally moving said probes toward and away of said track so as to contact both top and bottom terminals of the work piece positioned therebetween on said track, (f) a work piece rejection means in alignment with said track and adapted to receive inspected work pieces from between said electrical probes, (g) means for moving said rejection means out of the path of a work piece electrically rejected by said probes for ejecting the work piece from the apparatus, (h) an orientation probe for the work piece to determine the position of said designated leading edge as it is moved over said track for determining the further path of movement of the work piece into a storage container, (i) an actuating means connected to one of said electrical probes for movement therewith so as to actuate said orientation probe relative to a work piece as it is positioned on said track, and (j) a switching track means in alignment with said track and movable between separate storage containers and responsive to said orientation probe for directing all work pieces moving through the apparatus with said designated leading edge in a forward position into one of the storage containers.

2. An apparatus for inspecting, orienting, and sorting finished work pieces as defined by claim 1, wherein said feed means comprises a feed pawl positioned over and movable longitudinally of said track.

3. An apparatus for inspecting, orienting, and sorting finished work pieces as defined by claim 1, wherein said means for reciprocally moving said feed means relative to said track comprises a driven rotary cam plate and including a cam follower mechanism connected to said feed means.

4. An apparatus for inspecting, orienting, and sorting finished work pieces as defined by claim 1, wherein said means for reciprocally moving said probes comprises a pair of rotating cam drums with cam rollers carried by each set of electric probes with said cam drums adapted to move each probe in each set in opposite directions into and out of contact with the terminals of the work piece carried on said track.

5. An apparatus for inspecting, orienting, and sorting finished work pieces as defined by claim 1, wherein said means for moving said rejection means out of the path of a work piece comprises electric solenoids, the movable armature of which supports a gate plate normally disposed in alignment with said track and over which a tested finished work piece normally moves.

6. An apparatus for inspecting, orienting, and sorting finished work pieces as defined by claim 2, wherein said means for moving said rejection means out of the path of a work piece comprises electric solenoids, the movable armature of which supports a gate plate normally disposed in alignment with said track and over which a tested finished work piece normally moves.

7. An apparatus for inspecting, orienting, and sorting finished work pieces as defined by claim 5, wherein said means for reciprocally moving said feed means relative to said track comprises a driven rotary cam plate and including a cam follower mechanism connected to said feed means.

8. An apparatus for inspecting, orienting, and sorting finished work pieces as defined by claim 5, wherein said means for reciprocally moving said probes comprises a pair of rotating cam drums with cam rollers carried by each set of electric probes with said cam drums adapted to move each probe in each set in opposite directions into and out of contact with the terminals of the work piece carried on said track.

* * * * *